United States Patent [19]

Bauman et al.

[11] 4,418,011

[45] Nov. 29, 1983

[54] DETERGENT COMPOSITION PROVIDING ANTISTATIC PROPERTIES

[75] Inventors: Robert A. Bauman, New Brunswick; Robert C. Pierce, Plainsboro, both of N.J.

[73] Assignee: Colgate-Palmolive Company, New York, N.Y.

[21] Appl. No.: 404,795

[22] Filed: Aug. 3, 1982

[51] Int. Cl.[3] ..... C11D 1/52

[52] U.S. Cl. ..... 252/544; 252/8.6; 252/8.8; 252/89.1; 252/528; 252/547; 252/DIG. 2

[58] Field of Search ..... 252/8.6, 8.8, 523, 541, 252/525, 544, DIG. 2, DIG. 15, 89.1, 547, 528

[56] References Cited

U.S. PATENT DOCUMENTS

| | | | |
|---|---|---|---|
| 2,798,047 | 7/1957 | Touey et al. | 252/544 X |
| 2,805,205 | 9/1957 | Touey et al. | 252/544 |
| 3,326,807 | 6/1967 | Guest et al. | 252/525 |
| 3,425,863 | 2/1969 | Honig et al. | 252/8.8 X |
| 3,590,122 | 6/1971 | Roberts et al. | 252/117 X |
| 3,625,905 | 12/1971 | Weast | 252/109 |
| 3,692,704 | 9/1972 | Stamm et al. | 252/525 |
| 4,077,890 | 3/1978 | Barker | 252/8.8 |

FOREIGN PATENT DOCUMENTS

| | | |
|---|---|---|
| 47-3620 | 2/1972 | Japan . |
| 55-50082 | 4/1980 | Japan . |
| 639925 | 12/1978 | U.S.S.R. . |

*Primary Examiner*—P. E. Willis, Jr.
*Attorney, Agent, or Firm*—Norman Blumenkopf; Murray M. Grill; Herbert S. Sylvester

[57] ABSTRACT

An antistatic detergent composition useful in the laundering of fabrics containing nonionic surfactants, an antistatic amount of isostearic acid and a specified cationic polymer; and a method of imparting antistatic properties to fabrics during laundering, which consists in contacting fabrics with said composition in the wash cycle.

10 Claims, No Drawings

DETERGENT COMPOSITION PROVIDING ANTISTATIC PROPERTIES

BACKGROUND AND PRIOR ART

This invention relates to unbuilt nonionic-based detergent compositions to be used in the laundering of fabrics containing an antistatic amount of isostearic acid and a minor amount of a specified cationic polymer; and the method of imparting antistatic properties to fabrics laundered with said composition.

The use of various and diverse chemical materials and particularly cationic quaternary ammonium compounds as softeners and antistatic agents for textile products is very well known in the art. It is also well known to employ such materials for their antistatic and softening effects during the laundering operation and particularly in the rinse cycle of the laundering process. This latter technique has been necessitated by the fact that the aforesaid quaternary compounds heretofore employed, being mainly cationic in nature, were not compatible with the anionic detergents, one of the major types of detergents used in the washing cycle. Furthermore, cationic quaternary compounds are relatively ineffective in the presence of nonionic detergents.

It is also well known that there is a tendency for laundered articles to yellow or discolor when treated with aforesaid quaternary compounds.

Another disadvantage associated with the use of said cationic agents in the laundering of fabrics therewith is its interference with the deposition on the fabrics of optical brightener, thereby reducing optical brightener performance of a detergent composition containing said optical brightener.

Still another disadvantage of the cationic quaternary ammonium antistatic softener is its interference with the cleaning properties of the detergent by reducing the soil removal effected by the detergent, resulting in decreased washing effectiveness. The presence of the anionic detergent material substantially negates the fabric softening properties of the cationic quaternary ammonium compounds as well as counteracts the antistatic activity possessed by said quaternary compounds.

The use of water soluble cationic polymers as conditioning agents in hair treating compositions, which may optionally contain anionic, cationic, nonionic and/or amphoteric surfactants, is shown in U.S. Pat. No. 4,027,008 and British Pat. No. 1,347,051.

Isostearic acid has been used in an oil/water skin cream composition as a dispersing agent in said oil phase, shown in U.S. Pat. No. 4,087,555; as one component in a four component emulsifying or solubilizing composition, shown in U.S. Pat. No. 4,097,403; and as a conditioning agent in conjunction with a surfactant in shampoo compositions, shown in U.S. Pat. No. 3,590,122.

U.S. Pat. No. 3,625,905 discloses a cleansing and softening composition for fabrics comprising a noncationic surfactant and an alkali metal isostearate salt as the softening agent.

However, none of the prior art discloses an antistatic composition containing isostearic acid as the antistatic agent in a nonionic detergent composition containing a specific cationic polymer flocculent, to be used in the laundering of fabrics.

SUMMARY OF THE INVENTION

It has now been discovered that the addition of specified cationic polymers to a nonionic surfactant system containing isostearic acid as antistatic agent, permits the formulation of a system which can be preblended and perform effectively when added to the washer, in the disclosed combination of ingredients.

In a copending patent application, isostearic acid has been used as an effective wash cycle antistatic agent in the presence of a nonionic surfactant. However, the effectiveness was limited to use conditions where the isostearic acid and the nonionic surfactant were brought into contact only in the presence of a large volume of water in the washing machine. More specifically, the isostearic acid is separately added to the wash water containing the nonionic detergent, since it is ineffective as an antistat when premixed with the nonionic surfactant.

It has now been discovered that these components can be intimately mixed before addition to the washer provided a third component selected from a specified class of cationic polymers is also present. This permits formulation of nonionic detergents containing, as an integral component, an effective noncationic antistatic agent, in a more acceptable form to the consumer.

Accordingly, it is a primary object of the instant invention to provide a detergent formulation containing an intimate mixture of nonionic surfactant and isostearic acid, effective in affording antistatic protection to fabrics laundered therein.

Another object of this invention is to protect laundered fabrics against static generation by means of isostearic acid premixed with nonionic surfactant containing specified cationic polymers.

Another object of the instant invention is to provide such protection in conjunction with unbuilt nonionic detergent compositions during the home laundering process, with minimal interference with optical brightening.

A further object of the instant invention is to provide a method of imparting antistatic properties to fabrics during laundering with a nonionic detergent composition containing isostearic acid and certain cationic polymers, in the wash cycle of the laundering process.

Still a further object of instant invention is to provide a softening and antistatic composition which may be employed in conjunction with nonionic detergents and other cleaning, brightening and laundering additives in a single step laundering operation.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the present invention, as embodied and broadly described herein, the antistatic composition for laundering fabrics of this invention comprises an effective antistatic amount of isostearic acid, a nonionic detergent, and an acrylamide-based cationic polymer in an effective amount to overcome the inactivation of the antistatic properties by said detergent; and the method of imparting antistatic properties to fabrics comprises treating fabrics with aforesaid composition during laundering by directly adding to the wash cycle.

More specifically, present invention relates to an antistatic composition for laundering fabrics comprising an antistatic composition having a maximum pH of about 8 and comprising about 1–20% by weight of isostearic acid, a nonionic detergent and about 0.5–10% by weight of a cationic copolymer of an acrylamide with a quaternary ammonium monomer, and free of alkaline builder salts. This composition is added to the wash cycle during the laundering process.

Isostearic acid is a liquid $C_{18}$ saturated branched-chain isomer of stearic acid of the formula $C_{17}H_{35}COOH$, having primarily methyl branching. Isostearic acid is a water-insoluble oil having a molecular weight of about 284, a maximum titer of about 10° C., an iodine value of about 10 maximum, a saponification value of about 180 minimum and comprises preferably a methyl group in the 8, 9 or 10 position. However, said methyl group side chain may be positioned on any but the terminal carbon atom. A suitable commercial product is Emersol 871 (Emery Industries) which is a complex mixture of branched isomers of stearic acid.

Isostearic acid reduces or prevents the generation of static electricity on cotton and synthetic fabrics during laundering. These antistatic properties can be imparted to fabrics by laundering in a nonionic detergent composition containing isostearic acid and a cationic polymeric flocculent which improves the antistatic effectiveness of isostearic acid in nonionic detergents. The antistatic effectiveness which is lost if the isostearic acid is mixed with concentrated nonionic surfactant prior to use, is restored due to the presence of a cationic polymer in the detergent composition. The isostearic acid causes the codeposition of said nonionic surfactant and isostearic acid onto the fabric. The nonionic surfactant is rendered substantive to the fabric and is retained after rinsing due to the presence of isostearic acid. It is this unexpected coaction between the nonionic surfactant and the isostearic acid which imparts antistatic properties to fabrics treated herewith, since neither the isostearic acid per se, nor the nonionic surfactant per se is capable of imparting antistatic properties to fabric during the laundering process. This beneficial effect is achieved with minimal interference with the action of optical brighteners that may be present in the detergent composition.

It has additionally been found that the static decreases with the use of increasing amounts of isostearic acid, particularly on polyester (dacron), nylon, and polyester-cotton fabrics. Accordingly, the antistatic amount of isostearic acid may be as low as 1 g and up to 10 g per 60 liters of wash water, which is equivalent to about 0.002–0.02% of wash solution.

It has also been found that the pH of the wash water should not exceed 8, because the antistatic activity of isostearic acid is inactivated by the alkali. The presence of chlorine bleach in the wash water destroys the antistatic activity of the isostearic acid. This is probably due to the high alkalinity. Analysis indicates that most of the acid has been converted to the salt. This indicates the ineffectiveness of the isostearate salts as antistatic agents. The antistatic property is specific only to the isostearic acid in free acid form. The presence of salts such as $CaCl_2$ or $MgSO_4$ (as in hard water) does not adversely affect the antistatic properties of the isostearic acid, provided the pH does not exceed about 8. Accordingly, the detergent must be free of alkaline builder salts.

Another essential ingredient of the present composition is the cationic polymer which improves the antistatic effectiveness of isostearic acid in nonionic detergents, and restores the antistatic properties lost when isostearic acid is premixed with concentrated nonionic surfactant. However, these cationic polymers do not possess antistatic properties per se. They cause deposition of nonionic surfactant beyond the usual amount caused by isostearic acid. The water soluble cationic polymers effective herein are acrylamide-based polymers well known in the prior art. More specifically, they are copolymers of acrylamide and a quaternary ammonium monomer; such as the copolymer of acrylamide and dimethyldiallylammonium chloride. Specific examples of copolymers of acrylamide and a quaternary ammonium monomer are Hercofloc 812 and Merquat 550.

The amount of cationic polymer utilized in present nonionic detergent composition preferably constitutes about one-half by weight of the isostearic acid content, more specifically about 0.5–10% by weight of the detergent composition.

The amount of isostearic acid utilized in connection with nonionic detergent compositions is generally considered to be a relatively small proportion as compared to the weight of the active ingredients therein. It is noted, however, that one need only employ an effective amount of said isostearic acid which in fact produces the desired antistatic properties on fabrics. It is preferred that said isostearic acid be present in an amount of from about 1% to about 20%, of the total ingredients present in the detergent composition on a weight basis.

The composition of the instant invention may be employed in either particulate, liquid, tablet, or any other conventional form. Moreover, as noted above, the novel antistatic compositions disclosed herein may be employed in the wash cycle of the laundering process.

In accordance with this invention, the nonionic surfactants for use as the fabric detergent are commercially well known and include the primary aliphatic alcohol ethoxylates, secondary aliphatic alcohol ethoxylates, alkylphenol ethoxylates and the alcohol ethylene oxide-propylene oxide condensates such as Plurafacs (Wyandotte), and mixtures thereof. The nonionic synthetic organic detergents are generally the condensation product of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a nonionic detergent. Further, the length of the polyethenoxy chain can be adjusted to achieve the desired balance between the hydrophobic and hydrophilic elements.

The nonionic detergents include the polyethylene oxide condensate of one mole of alkyl phenol containing from about 6 to 12 carbon atoms in a straight- or branched-chain configuration with about 5 to 30 moles of ethylene oxide, for example, nonyl phenol condensed with 9 moles of ethylene oxide, dodecyl phenol condensed with 15 moles of ethylene and dinonyl phenol condensed with 15 moles of ethylene oxide. Condensation products of the corresponding alkyl thiophenols with 5 to 30 moles of ethylene oxide are also suitable.

Also included in the nonionic detergent class are the condensation products of a higher alcohol (e.g. an alkanol containing about 8 to 18 carbon atoms in a straight or branched-chain configuration) condensed with about 5 to 30 moles of ethylene oxide, for example, lauryl-myristyl alcohol condensed with about 16 moles of ethylene oxide.

A preferred group of nonionic surfactants are the Neodol ethoxylates (Shell Co.), which are higher aliphatic alcohol ethoxylates having about 5 to 20 ethyleneoxy groups per mole of aliphatic alcohol containing about 10–18 carbon atoms, such as $C_{12-13}$ alkanol condensed with 6.5 moles ethylene oxide, $C_{12-15}$ alkanol condensed with 12 moles ethylene oxide, $C_{14-15}$ alkanol condensed with 13 moles ethylene oxide, and the like. Ethoxamers having an HLB (hydrophobic lipophilic balance) value of about 8–15 gives good O/W emulsification, whereas ethoxamers with low HLB values (Below 8) contain less than 5 ethyleneoxy groups, and are poor emulsifiers and poor nonionic detergents. The nonionic surfactant may comprise from about 5–75% by weight of the total composition and usually varies from about 5–35% by weight.

The nonionic detergent composition of the instant invention may also include conventional laundering additives such as optical brighteners, germicides, soil suspending agents, anti-redisposition agents, antioxidants, coloring materials (dyes and pigments), perfumes, water-soluble alcohols, foam boosters, etc., provided they do not interfere with the antistatic activity of the isostearic acid.

DETAILED DESCRIPTION OF THE INVENTION

The following examples specifically illustrate the method of this invention. However, it is merely illustrative thereof and it is not limited thereto.

EXAMPLES 1–4

To 60 g of a homogeneous mixture of 33% Neodol 23-6.5[1], 0.66% Tinopal 5BM[2] (an optical brightener), 8.3% ethyl alcohol and 58% water is added with thorough mixing 4 g of isostearic acid and 2 g of Hercofloc 812[3] (a proprietary cationic copolymer manufactured by Hercules Inc.). As controls, are used 60 g quantities of the nonionic-brightener-alcohol-water mixture containing only Hercofloc 812, only isostearic acid or neither. Each of these mixtures are added to a washing machine while it is filled with 65 liters of tap water at 120° F. For the mixture containing neither polymer nor isostearic acid, 4 g isostearic acid is added separately. All experiments are duplicated in separate machines and the results averaged.

When agitation begins, a mixed fabric load of approximately 200 sq. in. swatches of polyester double knit twill (P), Banlon nylon (N), a 65–35% blend of polyester-cotton (PC), acetate jersey (A) and a cotton towel are added, the normal wash-rinse cycle is completed, and the fabrics are tumble dried. Antistatic effectiveness is determined by measuring the charge in kilovolts developed on the synthetic fabrics after rubbing 5 sec. with either wool (P, N and PC) or polyester (A). Brightener effectiveness is determined by measuring fluorescence ($R_b$) of the cotton towels.

| Ex. | Detergent Containing | Static In Dryer | Static Test* P | N | PC | A | $R_b$** |
|---|---|---|---|---|---|---|---|
| 1 | Isostearic acid | yes | 18.8 | 1.4 | 12.0 | 3.0 | 343 |
| 2 | Hercofloc 812 | yes | 12.5 | 6.3 | 6.3 | 7.5 | 310 |
| 3 | Isostearic Acid and Hercofloc 812 | no | 0.8 | 0.4 | 2.4 | 8.3 | 307 |
| 4 | Neither in detergent; Isostearic acid added separately | no | 0.7 | 0 | 0 | 0.3 | 333 |

*A lower number indicates better antistatic performance
**A higher number indicates better brightener performance
1 Ethoxylated $C_{12-13}$ aliphatic alcohol having an average of 6.5 moles ethylene oxide (Shell Co.)
2 A stilbene brightener (Ciba-Geigy)
3 A cationic copolymer of acrylamide and 2-(trimethylammonio) ethyl methacrylate methosulfate.

It is readily apparent that adding either isostearic acid or the cationic polymer Hercofloc 812 to a nonionic detergent before dilution with water in the washing machine (Examples 1 and 2) fails to protect fabrics laundered therein from static generation. However, adding both reagents to the detergent (Example 3) gives excellent static protection (with minimal interference with optical brightening) that is almost equivalent to that obtained by the separate addition of isostearic acid and detergent to the washer (Example 4).

EXAMPLES 5–12

In examples 6, 8, 10 and 12, 20 g Neodol 23-6.5, 4 g isostearic acid and 2 g (active basis) cationic polymers are premixed and added to 65 l tap water in a washing machine.

In examples 5, 7, 9 and 11, a detergent composition is formulated containing 33% nonionic Neodol, 8.3% ethyl alcohol, 58% water and 0.66% Tinopal brightener. A mixed load of polyester, nylon, acetate, polyester-cotton (65/35) and a cotton-polyester towel is laundered at 120° F./cold rinse and tumble dried. 2 g Hercofloc is premixed with the composition in Examples 7 and 8; 4 g of 50% active Gafquat in Examples 9 and 10; and 25 g (8% active) in Examples 11 and 12.

| Ex. | Cationic Polymer | Static From Dryer | Static* Value | Polyester wt. gain (g) | Towel $R_b$ | b |
|---|---|---|---|---|---|---|
| 5, 6 | None | yes | 17, 26 | 0, 0 | 360 | 1.4 |
| 7, 8 | Hercofloc 812[3] | No | 5, 7 | .15, .15 | 317 | 4.4 |
| 9, 10 | Gafquat 734[4] | Yes | 27, 31 | 0, 0 | 214 | 2.8 |
| 11, 12 | Merquat 550[5] | No | 13, 14 | .15, .37 | 310 | 3.9 |

*Charge developed on friction, summed for 4 fabrics
[4]Quaternary ammonium polymer from reaction of dimethyl sulfate and a copolymer of vinyl pyrollidone and dimethylaminoethyl methacrylate
[5]Polymeric quaternary from acrylamide and dimethyldiallylammmonium chloride monomer The towels from Hercofloc and Merquat runs, felt softer than the others (blind evaluation).

The material that adsorbed onto the polyester is removed by ether extraction, and is found by infrared spectra to consist of isostearic acid and an unusually large amount of Neodol 23-6.5 (nonionic surfactant).

Isostearic acid is not adsorbed by polyester, and is ineffective as an antistat when it is premixed with Neodol 23-6.5, as shown in Examples 5 and 6. However, the addition of either Hercofloc 812 or Merquat 550 (Examples 7, 8, 11 and 12), overcomes at least in part the inactivation of isostearic acid premixed with surfactant. Gafquat-containing composition in Examples 9 and 10 are ineffective in overcoming the inactivation of isostearic acid, showing the specificity of the class of effective flocculents.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

We claim:

1. An antistatic composition for laundering fabrics comprising an antistatic amount of isostearic acid, a nonionic detergent and an acrylamide-based cationic polymer in an effective amount to overcome the inactivation of the antistatic properties by said detergent.

2. The composition according to claim 1, additionally containing an optical brightener.

3. The composition according to claim 1, which is free of alkaline builder salts.

4. The composition according to claim 1, having a maximum pH of about 8.

5. The composition according to claim 1, wherein said cationic polymer is a copolymer of acrylamide and a quaternary ammonium monomer.

6. The composition according to claim 5, wherein the cationic polymer is a copolymer of acrylamide and dimethyldiallylammonium chloride.

7. The composition according to claim 1, wherein the nonionic detergent is the condensation product of an organic aliphatic or alkyl aromatic hydrophobic compound and hydrophilic ethylene oxide groups.

8. The composition according to claim 7, wherein said nonionic detergent is selected from the group consisting of primary aliphatic alcohol ethoxylates, secondary aliphatic alcohol ethoxylates, alkylphenol ethoxylates, alcohol ethylene oxidepropylene oxide condensates, and mixtures thereof.

9. A method of imparting antistatic properties to fabrics which comprises treating fabrics with the composition of claim 1 during laundering.

10. A method according to claim 9, wherein the composition is added directly to the wash cycle during laundering.

* * * * *